United States Patent [19]

Louden

[11] 4,393,103

[45] Jul. 12, 1983

[54] ERASABLE DENSE PAPER AND IMPROVED METHOD OF MANUFACTURING

[76] Inventor: William G. Louden, c/o Louden and Company, Erwinna, Pa. 18920

[21] Appl. No.: 297,104

[22] Filed: Aug. 28, 1981

[51] Int. Cl.[3] ..... B05D 3/02; B32B 23/08; B32B 27/10

[52] U.S. Cl. ..... 427/391; 428/511; 428/514

[58] Field of Search ..... 427/391; 428/511, 514

[56] References Cited

U.S. PATENT DOCUMENTS 3,839,144 10/1974 Louden ..... 162/141
3,989,416 11/1976 Louden ..... 427/361
4,058,648 11/1977 Louden ..... 428/511

OTHER PUBLICATIONS

M & T Chemicals, Inc., M & T Catalyst T-12, Sheet No. 174, Rev. 2/79.
M & T Chemicals, Inc., M & T Catalyst T-1, Sheet No. 277, Rev. C/GE.
M & T Chemicals, Inc., Inorganics and Organometallics, Bulletin C-60.

*Primary Examiner*—Michael R. Lusignan
*Attorney, Agent, or Firm*—Howson and Howson

[57] ABSTRACT

A paper which affords complete erasability of typewriter images is disclosed. The paper comprises a web of cellulosic fibers and a blend of a rigid polymeric material and a compatible filler together with a small but effective amount of tin carried by the web. A process for manufacturing the paper is also disclosed.

15 Claims, No Drawings

ERASABLE DENSE PAPER AND IMPROVED METHOD OF MANUFACTURING

BACKGROUND OF THE INVENTION

For many years, papers have been available which have permitted images typewritten thereon to be erased. The degree of erasability is, however, affected by a number of different factors. In virtually all typewriters, the image is applied by forcing a ribbon against the surface of the paper with a predetermined pressure. For any given paper composition, the amount of the pressure is known to affect the ability of the image to be erased, as well as the quality of the erasure. For instance, older typewriters, and some portable typewriters available today, rely upon finger pressure alonge to apply the image. Modern electric typewriters, however, apply greater pressures and, in some typewriters, the pressures are so great as to cause the paper actually to be embossed. In addition, the trend away from older type cloth ribbon to the more modern plastic ribbons has created additional erasure problems because the inks utilized on these two ribbons are significanly different.

Because of the evolutionary changes in typewriter machine design and typing ribbons, the performance requirements for erasable typewriter papers have become much more difficult to meet. The paper of the present invention meets these requirements.

DESCRIPTION OF THE PRIOR ART

The first erasable papers were made by a two-step process. In the process, paper fibers were refined in mechanical stock preparation equipment to increase the density of the fibrous mass to some extent. The mass was then laid on a paper machine wire bed and at least partially dried to form a web. Thereafter, at the size press of the paper making machine, the web was subjected to a treatment intended to fill the gaps and pores between the fibers. Usually, the treatment comprised a high solids, low viscosity degraded starch. Occasionally, a polyvinyl alcohol or carboxy methyl cellulose with insolubilizers were applied.

One of the primary difficulties of this process resides in the fact that it was difficult for a sufficient amount of the treatment to be applied to the web as to form a continuous coating which would provide an effective barrier to the typewriter ribbon ink. When one considers that the ink from the typewriter ribbon can be driven into the paper by the typewriter key, unless special precautions are taken to confine the ink to the surface of the paper at least temporarily, it should be apparent that the absence of an effective ink barrier reduces the erasability of the paper. To provide the effective barrier, a second coating of the same treatment was applied in a secondary off-machine operation. Because of the two-step process, early erasable papers were expensive to manufacture.

In addition to manufacturing costs, the two-step process had other disadvantages. For instance, the degraded starches applied at the size press tended to be sticky particularly in warm humid weather. This created machine operating difficulties. Moreover, the starches tended to transparentize the paper, and this results in a loss of opacity and a generally less attractive paper product. The papers were also sensitive to moisture and had a proclivity to curl readily under certain humidity conditions. It was also difficult to print on the papers, and while the erasing qualities of the papers were generally good on one side, they were poor on the other.

Another process which had been used in the past to manufacture erasable papers included the use of a sulfuric acid treatment. In this process, immersion of waterleaf paper in the acid bath gelatinizes the cellulosic fibers of the web, and the web is subsequently quenched in dilute acid or water. The cellulose gel tends to fill the capillaries and voids among the fibers and thereby provides an ink barrier which provides erasability.

Cellulosic fibers can also be gelatinized by subjecting them to excessive mechanical refining, similar to the refining used to produce "grease proof" papers. By introducing small amounts of unhydrated fibers, or alpha fibers, into the initial charge of pulp subjected to the mechanical refining equipment, a paper of sufficient density to provide erasability is produced. Such a process is described in Louden U.S. Pat. No. 3,839,144. While the paper produced by this process has a desirable degree of opacity, and the general appearance of quality of bond papers, the costs to manufacture this paper have been high due to the substantial amount of energy required in the pulp refining operation.

A dense paper which exhibits desirable erasability characteristics is disclosed in Louden U.S. Pat. No. 4,058,648. A process for producing such paper is disclosed in Louden U.S. Pat. No. 3,989,416. In the process, a cellulosic web of intermediate density is impregnated at the size press with a blend of a rigid polymeric material and an inorganic filler. This process produces erasable paper having excellent erasability, provided a sufficent amount of the blend is applied. The process overcomes the stickiness problems noted above with respect to gelatinized papers; the manufacturing costs are modest; and the process can be carried out on wide, conventional, high-speed paper making machines. Since the pulp requires less refining than required in the process disclosed in Louden U.S. Pat. No. 3,839,144, and somewhat less refining than required in the conventional two-step starch process described above, the paper is more economical to manufacture. Moreover, and most importantly, the dense paper can be manufactured in a single step process on the paper making machine, thereby eliminating post-treatment steps. The process overcomes the stickiness problems noted above with respect to the starch process and results in a paper having excellent opacity and good ink hold-out properties enabling it to be printed readily. Because of these factors, the process has been used extensively for the production of erasable bond papers.

While the dense paper produced in accordance with the process disclosed in Louden U.S. Pat. No. 3,989,416 provides excellent erasability when manufactured under ideal conditions, in practice it has been found difficult to maintain ideal process conditions. When process conditions are less than ideal, the resulting paper exhibits less than ideal erasability characteristics, such as the inability for a typed image to be erased promptly after application, i.e. within several minutes after having been applied by the typewriter. The ideal erasable paper should exhibit complete erasability on both sides of the sheet without significant variation in the same production run or from one run to another.

In practicing the process of Louden U.S. Pat. No. 3,839,144 on paper making machines in a paper making plant, it has been found necessary to maintain the solids content of the impregnating blend of polymeric material and filler above about 45% but below about 55% in order to insure the production of an erasable paper having the most desirable erasability characteristics. In practice, it has been found that when the solids content drops below the lower level, erasability begins to be affected adversely. On the other hand, when the solids content of the treating medium increases above the upper level, operating problems occur. For instance, the viscosity of the treatment medium increases and this adversely affects impregnation. In addition, there is a greater tendency for the treatment medium to foam, and this is undesirable. Other difficulties include the necessity to maintain the web at a certain minimum density in a 9–10 pound per mil. range prior to impregnation. Substantial variations from the density have been found to affect adversely the erasability of the resulting paper product.

OBJECTS OF THE INVENTION

With the foregoing in mind, a primary object of the present invention is to overcome the limitations of prior art processes for producing dense papers.

It is another object of the present invention to provide an improved process for producing a dense paper product which has particular utility as an erasable bond paper but which may be used in other applications where emulsion or solvent hold-out qualities are desirable characteristics, such as a carrier for release coatings, printing papers and the like.

As a further object, the present invention provides a novel process for making a paper producing having an improved hold-out capability for polymers carried in solvent, or aqueous, mediums.

It is a still further object of the present invention to reduce the operational difficulties associated with producing dense papers in accordance with the process disclosed in Louden U.S. Pat. No. 3,989,416.

Yet another object of the present invention is to increase the uniformity of quality of the dense paper produced in accordance with the process of Louden U.S. Pat. No. 3,989,416.

SUMMARY OF THE INVENTION

More specifically, it has been found that the addition of a small amount of an organic compound of tin to the rigid polymeric material and compatible inorganic filler to form a blend which is applied to a paper web overcomes the limitations of the prior art processes and produces a dense paper product which exhibits excellent erasability in a consistent manner while minimizing production difficulties. Specifically, it has been discovered that the blend of the polymeric material and filler including from about 0.1% to about 2.0%, by weight, of the organic tin compound, based on the weight of the polymeric material and filler, provides the desired results. Preferred tin compounds include dialkyl tin dicarboxylates where the alkyl chain includes at least 4 and more preferably 12, carbon atoms and where the carboxylates include alkyl carboxylic acids having a chain length of at least 12, and preferably up to about 18, carbon atoms. Other effective tin compounds are also disclosed.

A process for manufacturing the dense paper is also disclosed.

DESCRIPTION OF PREFERRED PRODUCT AND PROCESS

The present invention provides a dense paper product which is an improvement over the product disclosed in Louden U.S. Pat. No. 4,058,648, and the process of the present invention is an improvement over the process described in Louden U.S. Pat. No. 3,989,416. While certain aspects of the disclosures contained in the aforementioned patents will be discussed hereinafter in order to provide a basis for understanding the present invention, reference is made to those patents for a more complete understanding of the product and process with which the present invention is concerned, and thus, the disclosures of Louden U.S. Pat. Nos. 3,989,416 and 4,058,648 are incorporated by reference herein.

In the aforementioned Louden patents, a blend of a rigid polymeric material having a glass transition temperature ($T_g$) within a predetermined range was combined with an inorganic filler to produce a blend which was impregnated in a web of cellulosic fibers to produce a dense paper having certain desirable characteristics, including erasability. The web had a density in a range of about 7–14 lbs./mil prior to impregnation and, after impregnation, the resulting paper included about 8½ to about 50% by weight of the blend based on the dry weight of the web. The $T_g$ of the rigid polymeric material was in a range of between about 15° to about 60° C., and preferably within a range of about 22° to about 44° C. The polymeric material included polyvinyl acetate, polyacrylate, polyvinyl chloride, or mixtures thereof, and copolymers and homopolymers thereof. The inorganic fillers included clay, calcium carbonate, mica, and talc or blends thereof. The impregnant consisted essentially of from about 35 to 90% of the rigid polymeric material and from about 10 to about 65% of the compatible inorganic filler. The inorganic filler was in a range of between about 20 to about 65% of the weight of the impregnant, and the impregnant was in a range of between about 15 to about 40% of the finished weight of the paper. The paper had a finished uncalendered density of at least about 10.5 lbs./mil. and less than about 16.0 lbs./mil. based on 500 sheets 24 in.×36 in.

The blend was applied to the paper web by causing the web to advance through an aqueous dispersion containing the blend for impregnating the web, and thereafter removing the excess dispersion and forcing the impregnant into the interior of the web. The solids content of the dispersion, on a weight basis, was maintained in a range of between 12½ and about 60% of the total weight of the dispersion. After impregnation and removal of excess dispersion, the web was heated to a temperature of about 100° C. to dry the web and fuse the blend therein.

In accordance with the present invention, it has been discovered that a dense paper can be produced having consistently good erasability characteristics on both sides of a sheet from one run to another. Moreover, such paper can be produced with greater ease than that with which the paper of the aforementioned Louden U.S. patents could be produced. This is because the present invention affords web treatment with an aqueous dispersion having a solids content within a wider range. As a result, viscosity control is less critical, and there is less of a tendency for the dispersion to foam during treatment of the moving web.

To this end, it has been discovered that the addition of a small amount of an inorganic compound of tin to the rigid polymeric material and the filler provides a blend which, when formed into a aqueous dispersion and applied to a web of predetermined density, produces a dense paper having the above-noted desirable characteristics but without the above-noted undesirable manufacturing difficulties. The organic tin compound should exceed about 0.10% of the combined weight of the rigid polymeric material and filler, and more preferably, the organic compound of tin should be within a range of about 0.20% to about 2.0% on a weight basis. When manufactured as disclosed hereinafter, such relatively small percentages of tin have been found sufficient to afford complete erasure of a typewriter-applied image when the image is erased promptly after it is applied to the finished paper.

The organic compound of tin may include dialkyl tin dicarboxylates of which the preferred ones include an alkyl group having at least 4 carbon atoms with greater numbers of atoms in the chain length, such as 8 being even more preferable. The carboxyl group is preferably provided by carboxylic acid having a chain length as great as possible, such as 12 carbons in lauric acid or 18 carbons in stearic acid. Preferred dialkyl tin dicarboxylates may be selected from the group consisting of: dioctyl tin dilaurate, dibutyl tin distearate, dibutyl tin di 2-ethyl-hexoate, dibutyl tin di B-mercapto propionate, dibutyl tin dilaurate, dibutyl tin diacetate, and dioctyl tin di b-isooctyl mercapto acetate.

Other organic tin compounds having short chain esters, such as chloride or acetate, and certain mercapto acids such as di B-mercapto propionic acid or b-isooctyl mercaptoacetic acid provide some benefit. Also, dilauryl tin dichloride and tri n-butyl tin oxide may be used beneficially. It is believed that dialkyl tin sulfates and dialkyl tin nitrates should function satisfactorily along with halogenides and mercapto acetates.

The aforementioned organic compounds of tin are formulated with the rigid polymeric materials and inorganic fillers set forth in the Louden patents to form a blend which is applied to a web as an aqueous dispersion. The blend thus comprises from about 35% to about 90% of the rigid polymeric material, from about 10 to about 65% of the inorganic filler, and up to about 2% of the organic compound of tin. The $T_g$ of the rigid polymeric material is in a range of between 15° to about 60° C., and more preferably about 22° to about 44° C. Preferred polymeric materials include polyvinyl acetate, polyacrylate, and polyvinyl chloride, or mixtures thereof, as well as copolymers and homopolymers thereof. Preferred inorganic filler materials include clay, calcium carbonate, mica and talc, or blends thereof. Most preferably, the inorganic filler is in a range of about 20 to about 65% of the weight of the blend. The blend comprises between about 15 to about 40% of the finished weight of the paper.

The finished paper has an uncalendered density in a range of about 10.5 to about 16 lbs./mil., based on 500 sheets 24 in.×36 in. The paper includes a web which, prior to treatment with the blend, has a density in a range of about 7 to about 14 lbs./mil., and more preferably in a range of about 8.5 to about 10.5 lbs./mil. After treatment with the blend, the resulting paper contains between about 8.5 to about 50%, by weight, of the blend, the weight being based on the dry weight of the web.

In order to realize all of the advantages of the present invention, the blend should be applied to the web as an impregnant, i.e. dispersed throughout the web. If desired, however, less than all but a substantial number of advantages can be realized by applying the blend as a coating carried predominately on the surfaces of the web. For example, coating may be desirable in those applications where ink hold-out properties and erasability are of greater concern than fold endurance and resistance to delamination. Thus, while the blend is most preferably applied as an aqueous dispersion which is impregnated in the web at the sizing press, the blend may be applied by gate rollers which, while causing some impregnation of the web, tend to predominately coat the surfaces of the web. The blend may also be applied by reverse roll, trailing blade, rod or air knife techniques. After the web has been treated with the aqueous dispersion, it is dried at about 100° C. to a predetermined moisture level. The drying temperature is above the upper limits of the glass transition temperature ($T_g$) of the polymeric materials, and the polymeric materials are thermoplastic. Preferred polymeric materials include: Vinac 881 manufactured by Air Products and Chemical Company of Allentown, Pennsylvania; Rhoplex AC-201 and TR-407 manufactured by Rohm & Haas Company of Philadelphia, Pennsylvania; and Geon 351 manufactured by B. F. Goodrich Chemical Co. of Akron, Ohio.

A compatible pigment or filler includes delaminated clay, such as Hydroprint manufactured by J. M. Huber Corporation of Huber, Ga.; calcium carbonate such as Camelwite sold by Harry T. Campbell's Sons of Towson, Md.; talc such as Mistron Vapor sold by United Sierra Div. of Cypress Mines, of Trenton, N.J.; and mica such as Davenite Mica sold by The Hayden Mica Co. of Wilmington, Mass.

SUMMARY OF THE EXAMPLES

In order to demonstrate various aspects of the use of the organic tin compounds in making paper having improved erasability, several tests have been conducted, and the results are set forth in Examples I–VIII.

Example I demonstrates the effectiveness of using a small amount of an organic tin compound in a rigid polymerfiller blend applied to a paper web.

Example II demonstrates the use of an organic tin compound to expand the range of solids content of a treating dispersion to provide desired levels of erasability in the finished paper products.

Example III demonstrates the amount of a tin compound which is necessary to provide a paper product having the desired degree of erasability.

Example IV demonstrates the need for certain ingredients to be present in combination with the tin compound to produce the desired degree of erasability.

Example V sets forth certain compounds of tin which have been tested for use in making paper according to the present invention.

Example VI sets forth certain rigid polymeric materials which have been tested for use in making paper according to the present invention.

Example VII demonstrates the interaction of a clay filler with an organic tin compound in producing a paper product according to the present invention.

Example VIII provides a comparison of various types of inorganic fillers and their effect on blends in which organic tin compounds are employed.

Example IX demonstrates the differences between impregnating and coating the base paper.

EXAMPLE I

In order to demonstrate the relative efficacy of an organic compound of tin in a paper treating composition, two samples of paper were prepared and tested for erasability. One sample (the control) did not include any tin; the other sample (the improved) included a stated amount of a tin compound. In this example, the organic compound of tin included dialkyl tin dicarboxylate.

To emulsify the dialkyl tin dicarboxylate, a 2% solution of polyvinyl alcohol in water was first prepared. The polyvinyl alcohol was Vinol 523, manufactured by Air Products and Chemical Company of Allentown, Pa. Eight parts of Vinol 523 were dispersed in 392 parts of cold water, with agitation. The temperature of the mixture was gradually increased, with agitation, to about 180° F. After about five minutes of agitation at elevated temperature, the Vinol dissolved completely.

A second solvent mixture was prepared by mixing 33 parts of 1,1,1, trichlorethane with 66 parts of toluene.

Ten parts of dioctyl tin dilaurate were measured out into a beaker. To this, 1 part of the 1,1,1, trichlorethane-toluene blend described above was added with mixing. This blend was agitated using a high sped laboratory mixer, and 40 parts of the 2% aqueous solution of Vinol was gradually added with vigorous agitation. A stable emulsion was formed which was water dilutable. The solids content of the emulsion was 19.6%.

Thereafter 48 parts of water were weighed into a beaker equipped with a high speed laboratory stirrer. To this, approximately 0.01% tetrasodium pyrophosphate was added as a dispersant for the pigment or filler. Gradually, with good agitation, 36 parts of Hydroprint delaminated clay manufactured by J. M. Huber Corporation, of Huber, Ga. was added. The clay dispersed well. To this dispersion, 50 parts of Vinac 881 polyvinyl acetate emulsion (48% solids) manufactured by Air Products and Chemical Company of Allentown, Pa. was added with mild stirring. The pH was adjusted to 10 with ammonia. To this mixture, 1.2 parts of 19.6% dioctylitin dilaurate emulsion was added with mild mixing.

A second treating dispersion was prepared which was identical with the above-described mixture except that the dioctyltin dilaurate was omitted.

An unsized paper of basis weight 35.8 lbs. (24"×36"-500 sheets) made from a blend of approximately 60% softwood northern kraft and 40% hardwood northern kraft was used as the test paper. The caliper of paper was 2.83 mils. providing a density of 12.7 lbs./mil. The paper sheets were dipped in the dispersion and, after withdrawal, were passed through rubber rollers where excess was squeezed from the sheets. The impregnated sheets were then dried for four minutes at 220° F., two minutes each side in a Williams sheet drier.

Sheets were made using the two formulations described above as impregnants.

In order to measure the erasability of the prepared sheets, and to provide a standard used hereinafter, a standard SCM portable electric typewriter was used, together with a standard black cloth ribbon. The test was conducted by typing on each test sample and immediately observing the difficulty or ease with which the typed characters could be removed by rubbing with an ordinary pencil eraser.

Rubbing was continued until either all the image was removed or until no further change in the residual image occurred on continued rubbing, such as occurs when the ink has been driven into the interior of the paper.

A rating system for the degree of erasability has been devised based on the intensity of the residual image, as judged against standards. The rating is as follows:

| Rating | Description |
|---|---|
| #1 Excellent erasure | No sign of residual image after a few rubs. |
| #2 Excellent to Good | A trace of residual image remains, even after sustained rubbing. |
| #3 Good | Almost all of the image can be removed, but there is a definite sign of residual image. |
| #4 Fair | All of the image is quite visible even after sustained rubbing; however, a sizable portion of the intensity of the image is attenuated. |
| #5 Fair to Poor | Image intensity greater than #4. |
| #6 Poor | Erasure barely discernable. Some erasability but major portion of image intensity still present. |

In erasability tests on treated sheets (with and without dioctyl tin dilaurate), the results are shown in Table I, below.

TABLE I (Tin vs. No-Tin)

| Sample | Erasability |
|---|---|
| Control - No dioctyl tin dilaurate present "A" | 2 |
| Improved - Approximately 0.4% dioctyl tin dilaurate present "B" | 1 |

The erasing qualities of Sample "B" with dioctyl tin dilaurate present in the formulation were better than Sample "A". The image was removed more readily, and there was no residual image at all. In the case of Sample "A" without the dioctyl tin dilaurate, more rubbing waas necessary and there was a trace of a residual image.

EXAMPLE II

In order to demonstrate the effect on erasability of variations in the treatment strength of the erasable treating formulations, a series of treating mixtures, the same as those described in Example I, were prepared, both with and without the addition of dioctyl tin dilaurate. The solids contents of the treating mixtures were 45%, 40%, 35% and 30%. Thus, by diluting the treating formula, lesser amounts of treatment were applied with each stepwise drop in treatment strength. All other procedures were the same as in Example I. The results are shown in Table II, below.

TABLE II (Effect of Solids Content on Erasability)

| Treating Formulation | Erasability | | |
|---|---|---|---|
| Solids Content | No dioctyl tin dilaurate | 0.4% dioctyl tin dilaurate* | 2% dioctyl tin dilaurate* |
| 45% | 2 | 1 | 1 |
| 40% | 4 | 2 | 1 |
| 35% | 5 | 2 | 1 |

TABLE II-continued (Effect of Solids Content on Erasability)

| Treating Formulation | Erasability | | |
|---|---|---|---|
| Solids Content | No dioctyl tin dilaurate | 0.4% dioctyl tin dilaurate* | 2% dioctyl tin dilaurate* |
| 30% | 6 | 3 | 2 |

*Percent dioctyl tin dilaurate solids based on combined weight of pigment (filler) and polymer solids.

From the above table, it is clear that when 0.4% and 2% dioctyl tin dilaurate are present in the treating formulation, it is possible to use weaker treating solutions and still obtain acceptable erasure.

In manufacturing erasable bond papers, it is desirable to produce a paper having a rating of "1" as much of the time as possible, and as a practical matter, not to fall below "2". The data clearly shows that in the treating formula having no dioctyl tin dilaurate present, the critical point in the solids content of the treating formulation is somewhere between 40% and 45%. On the other hand, with 0.4% dioctyl tin dilaurate present a rating of "1" can be maintained at 45% solids, and a rating of "2" can be held at a solids content as low as 35%. Superior erasability can be maintained if the solids content is held at 45%. With 2% dioctyl tin dilaurate present a "1" rating can be held down to 35% solids, and a "2" rating can be held at 30% solids.

EXAMPLE III

In order to determine how much dialkyl tin dicarboxylate was necessary to improve the erasing qualities of the polymer-pigment blend described in Example I, the amount of dioctyl tin dilaurate emulsion described in Example I was varied. All other conditions were the same. Erasure results are set forth in Table III, below.

TABLE III (Amount of Tin vs. Erasability)

| Percent of dioctyl tin dilaurate added | Erasability |
|---|---|
| None | 2 |
| 0.05% | 2 |
| 0.20% | 1 |
| 0.40% | 1 |
| 1.96% | 1 |

From the above, it is apparent that the addition of between 0.05% and 0.20% (about 0.10%) of dioctyl tin dilaurate (based upon total pigment-polymer solids) causes observable differences in erasability to occur, with improvement levelling off below about 2.0%. Example II showed that improvements are observable when the treating solution is more dilute (at 30% solids) at the higher level (2.0%) of dioctyl tin dilaurate.

EXAMPLE IV

In order to determine which, if any, of the polymer-filler components of the treating formula has the greatest affect on erasability when dialkyl tin dicarboxylates are present, a further test was conducted.

In this test, 48 parts of water were weighed into a beaker equipped with a high speed laboratory stirrer, and to this water approximately 0.01% tetrasodium pyrophosphate was added as a dispersant for pigment (filler). Gradually, with good agitation, 36 parts of Hydroprint delaminated clay manufactured by J. M. Huber Corporation of Huber, Ga. was added. The clay dispersed well. To this dispersion, 50 parts of Vinac 881 manufactured by Air Products and Chemical Company of Allentown, Pa. was added with mild stirring. The pH was adjusted to 10 with ammonia. This treating mixture was identified as "A".

A second treating mixture was prepared with the same proportions as "A" but with 1.2 parts of 19.6% dioctyl tin dilaurate emulsion having been added with mild mixing. This formulation was identified as "B".

A quantity of Vinac 881 at 48% solids was obtained and was identified as treating formulation "C".

A mixture of 50 parts of Vinac 881 and 1.2 parts of dioctyl tin dilaurate emulsion was prepared and was identified as formulation "D".

The same base paper as described in Example I was used in these experiments. Paper sheets were dipped in the various formulations; excess was squeezed off; and the sheets were dried exactly as in Example I. The same procedure was used to test erasability. Results are set forth in Table IV, below.

TABLE IV (Effect of Blend Components on Erasability)

| Formulation | Erasability |
|---|---|
| A | 2 |
| B | 1 |
| C | 3 |
| D | 3 |

From the above table it may be seen that the addition of dioctyl tin dilaurate has a beneficial effect on erasability only when clay is present in the formulation. While this phenomenon cannot be fully explained, it is believed that the treating formula absorbs on the surface of the clay and orients in a certain fashion at the surface interface in such a manner that ink receptivity of the surface is reduced.

EXAMPLE V

To demonstrate some of the organic compounds of tin which can be used effectively in the present invention, certain tin compounds were emulsified, using the identical emulsification procedure outlined in Example I. The emulsions were used within two days of their making, and they were thoroughly mixed before addition to the polymer-pigment formulation.

In each case, 0.4% of the tin compound was added to the mixture of Vinac 881 and Hydroprint clay described in Example I, except that the treating formula was diluted with water to contain 35% solids. Sheets of paper were dipped in each formulation; excess was squeezed off; and the sheets were dried. Erasure tests were performed, and each sample was rated according to the scale previously described. The results are set forth in Table V, below.

TABLE V (Effects of Various Tin Compounds on Erasability)

| Tin Compound | Erasability |
|---|---|
| dioctyl tin dilaurate | 2 |
| dibutyl tin distearate | 2 |
| dibutyl tin di 2-ethyl-hexoate | 2 |
| dibutyl tin di b-mercapto propionate | 2 |
| dibutyl tin dilaurate | 3 |
| dilauryl tin dichloride | 4 |
| tri n-butyl tin oxide | 4 |
| dibutyl tin diacetate | 4 |
| dioctyl tin di b-isooctyl mercapto acetate | 4 |
| none | 5 |

The above data show that the dialkyl tin dicarboxylates are particularly effective in improving the erasability of rigid polyvinyl acetate clay blends used to impregnate base papers. The number of carbon atoms in the alkyl group should be at least four, although a greater number of carbon atoms, such as eight in octyl, is preferred. The chain length of the carboxylic acid should be as long as possible, such as eighteen in stearic or twelve in lauric. However, short chain esters such as chloride or acetate provide acceptable results. Also certain mercapto acids such as di-b-mercapto propionic acid or b-isooctyl mercaptoacetic acid provide some benefit. Tri n-butyl tin oxide appears to provide some benefit, also.

EXAMPLE VI

For the purpose of determining whether the benefits derived from addition of organic tin compounds to rigid polyvinyl acetate clay blends are restricted to the use of polyvinyl acetate, or whether other rigid polymers may be substituted for the polyvinyl acetate, certain additional tests were conducted.

In these tests, 36 parts of Huber Hydroprint clay were dispersed in 44.8 parts of water as described in Example I. To this clay slurry, 52.7 parts of Rhoplex AC-201 (a rigid acrylic polymer manufactured by the Rohm and Haas Company, Washington Square, Philadelphia, Pa.) was mixed with mild stirring. The pH was adjusted to b 10. Base paper as in Example I was treated with this formula as in Example I at 45% solids.

An identical mixture was prepared, except that 1.2 parts of dioctyl tin dilaurate emulsion at 19.6% solids was mixed in.

Another formulation was prepared using Rhoplex TR-407 in place of the Rhoplex AC-201.

A still further formulation was prepared by dispersing 36 parts of Huber Hydroprint clay in 44.8 parts of water as described in Example I. To this clay slurry, 50 parts of Geon #351 rigid polyvinyl chloride latex manufactured by B. F. Goodrich Chemical Company of Akron, Ohio was mixed with mild stirring. The pH was adjusted to 10. Base paper as in Example I was treated with this formula at 45% solids. Sheets were dried for two minutes at 350° F. An identical mixture was prepared except that 1.2 parts of dioctyl tin dilaurate emulsion at 19.6% solids was mixed in.

Erasure tests were made on all the sample sheets prepared. Results are summarized below in Table VI.

TABLE VI (Effect of Various Polymeric Materials on Erasability)

| Composition Polymer Type | Erasability: No dioctyl tin dilaurate | Erasability: 0.4% dioctyl tin dilaurate |
|---|---|---|
| Rhoplex AC-201 | 3 | 1 |
| Rhoplex TR-407 | 2 | 1 |
| Geon 351 | 4 | 3 |

From the above, it should be apparent that erasability is improved using rigid acrylic and rigid polyvinyl chloride clay blends with dioctyl tin dilaurate emulsions added.

EXAMPLE VII

In order to determine the amount of clay which should be present in the rigid polyvinyl acetate clay blend to provide satisfactory erasability when an organic tin compound is included in the blend, further tests were conducted.

In these tests, a first mixture was provided when 2.7 parts of Hydroprint clay were dispersed in 6.6 parts of water in the presence of 0.01% of tetrasodium pyrophosphate. 50 parts of Vinac 881 was added with mild stirring. The pH was adjusted to 10 with ammonia. In a companion mixture 1.6 parts of dioctyl tin dilaurate emulsion at 19.6% solids was added. These mixtures had a ratio of 10 parts clay to 80 parts Vinac 881.

A second mixture was prepared having 44.6 parts of Hydroprint clay dispersed in 57.8 parts of water with 0.01% tetrasodium pyrophosphate present. To this, 50 parts of Vinac 881 was added with mild stirring, and the pH was adjusted to 10 with ammonia. In a companion mixture, 1.4 parts of a 19.6% solids dioctyl tin dilaurate emulsion was added to the same formulation. These mixtures had a ratio 65 parts of clay to 35 parts Vinac 881.

A third mixture was prepared having 56 parts of Hydroprint clay dispersed in 71.7 parts of water in the presence of 0.01% tetrasodium pyrophosphate. 50 parts of Vinac 881 was added with mild stirring. The pH was adjusted to 10 with ammonia. In a companion mixture, 1.6 parts of a 19.6% solids dioctyl tin dilaurate emulsion was added to the same formulation. These mixtures had a ratio of 70 parts clay to 30 parts Vinac 881.

A base paper as described in Example I was treated with each of these formulations according to the same procedure. All samples were tested for erasability. Results are set forth in Table VII, below.

TABLE VII (Effect of Amount of Filler on Erasability)

| Formulation Percent Clay | Erasability: No dioctyl tin dilaurate | Erasability: 0.4% dioctyl tin dilaurate |
|---|---|---|
| 10 | 2 | 1 |
| 65 | 2 | 1 |
| 70 | 6 | 6 |

Thus, it is clear that the presence of at least 10% clay in the polyvinyl acetate rigid polymer blend is sufficient to ensure the effectiveness of the dialkyl tin additive. If, however, the amount of clay exceeds the critical pigment-binder ratio, and the continuous phase provided by the polyvinyl acetate is no longer present then none of the advantages of the tin compound additive in improving erasability is realized.

EXAMPLE VIII

In order to determine whether or not certain other types of pigments (fillers) could be substituted effectively for clay, yet another test was conducted.

In this test, 36 parts of calcium carbonate pigment sold under the trademark CAMELWITE by the Charles T. Campbell Company of Towson, Md., was dispersed in 47.5 parts of water in the presence of a trace (0.01%) of tetrasodium pyrophosphate. 50 parts of Vinac 881 polyvinyl acetate emulsion was added with gradual stirring. The pH was adjusted to 10 with ammonia. The solids content was 45%, and the ratio of Vinac 881 to calcium carbonate was 40 parts Vinac to 60 parts calcium carbonate. In a companion mixture 1.2 parts of 19.6% dioctyl tin dilaurate emulsion was added.

A second mixture was formulated using talc sold under the trade name MISTRON VAPOR by the United Sierra Division of Cypress Mines, Trenton, N.J., dispersed in 47.5 parts of water in the presence of 0.01% tetrasodium pyrophosphate. 50 parts of Vinac 881 was added with gradual stirring. The pH was adjusted to 10 with ammonia. The solids content was 45%, and the ratio of Vinac 881 to talc was 40 parts Vinac to 60 parts talc. In a companion mixture 1.2 parts of 19.6% dioctyl tin dilaurate emulsion was added.

A third mixture was formulated having mica powder sold under the trade name DAVENITE MICA by the Hayden Mica Company, Wilmington, Mass. dispersed in 47.5 parts of water in the presence of 0.01% tetrasodium pyrophosphate. 50 parts of Vinac 881 was added with gradual stirring. The pH was adjusted to 10 with ammonia. The solids content was 45%, and the ratio of mica in the blend was 40% Vinac to 60 parts mica. In a companion mixture, 1.2 parts of 19.6% dioctyl tin dilaurate emulsion was added.

The sheets were prepared as in Example I and similarly tested for erasability. The results are set forth in Table VIII, below.

TABLE VIII (Effect of Various Fillers on Erasability)

| Formulation Pigment | Erasability: No dioctyl tin dilaurate | Erasability: 0.4% dioctyl tin dilaurate |
|---|---|---|
| Calcium Carbonate | 2 | 1 |
| Talc | 5 | 2 |
| Mica | 2 | 1 |

From the above data, it should be apparent that the presence of calcium carbonate, talc, mica or clay in the rigid polymer blend makes it possible for the organic tin compound to improve erasability.

EXAMPLE IX

For the purpose of demonstrating the effect on erasability of applying the blend as a coating as compared with impregnating, a further test was conducted.

In this test, two blends: A and B, were prepared as in Example I. Blend A did not include any organic tin compound; Blend B included approximately 0.4% dioctyl tin dilaurate. Two base paper sheets as in Example I were impregnated, one with Blend A and one with Blend B and two base paper sheets were coated with the blends. The coating was applied to one side of the sheets using a No. 12 wire wound coating rod. The coated paper was dried in an oven at 220° F. for two minutes.

Erasure tests as described heretofore were performed.

The test results are set forth in Table IX.

TABLE IX (Effect of Coating v. Impregnating)

| Sample | Erasability (Impregnated) | Erasability (Coated) |
|---|---|---|
| Blend A (no tin compound) | 2 | 3 |
| Blend B (tin compound) | 1 | 2 |

From the above data, it should be apparent that while a paper web coated on one side provides acceptable erasure on the coated side, an impregnated paper web provides even better erasure.

In view of the foregoing, it should be apparent that the present invention provides an improved erasable paper and an improved method of manufacturing the same.

Thus, while a preferred product and manufacturing method have been described in detail, various modifications, alterations and changes may be made without departing from the spirit and scope of the present invention as defined in the appended claims.

I claim:

1. A process for manufacturing dense paper comprising the steps, performed in the following sequence, of:

advancing a web of paper having a dry uncalendered density in a range of between about 7 to about 14 lbs./mil.;

applying to the advancing web an aqueous dispersion containing a blend of a rigid polymeric material and an inorganic filler, said blend consisting essentially of from about 35 to about 90% of said polymeric material, from about 10 to about 65% of said inorganic filler, and an organic compound of tin in a range of about 0.10% to about 2.0%, said percentages being by weight based on the non-tin portion of the weight of the blend, said rigid polymeric material having a glass transition temperature in a range of between about 15 to about 60° C.;

removing the excess dispersion from said web; and heating said web after the excess dispersion has been removed to fuse said blend to said web so that the resulting paper comprises in a range of between about 8.5% to about 50%, by weight of the blend, said weight being based on the dry weight of the web.

2. The process according to claim 1 wherein said organic compound of tin is in a range of about 0.10% to about 2.0%, by weight, based on the combined weight of the polymeric material and filler.

3. The process according to claim 2 wherein said organic compound of tin includes dialkyl tin dicarboxylates.

4. The process according to claim 3 wherein said dialkyl tin dicarboxylates include an alkyl group having at least four carbon atoms.

5. The process according to claim 4 wherein said alkyl group has about eight carbon atoms.

6. The process according to claim 3 wherein said dialkyl tin dicarboxylates include a carboxyl group having a chain of at least twelve carbon atoms.

7. The process according to claim 3 wherein said dialkyl tin dicarboxylates are selected from the group consisting of dioctyl tin dilaurate, dibutyl tin distearate, dibutyl tin di 2-ethyl-hexoate, dibutyl tin di B-mercapto propionate, dibutyl tin dilaurate, dibutyl tin diacetate, and dioctyl tin di b-isooctyl mercapto acetate.

8. The process according to claim 1 wherein said compound of tin is selected from the group consisting of dilauryl tin dichloride and tri n-butyl tin oxide.

9. The process according to claim 1 wherein said blend is impregnated in said web.

10. The process according to claim 1 wherein said blend is carried predominately on the surface of said web.

11. The process according to claim 1 wherein the density of said paper web prior to application of said blend is in a range of between about 8.5 to about 10.5 lbs./mil.

12. The process according to claim 1 wherein said web is substantially free of sizing prior to application of said blend.

13. The process according to claim 1 wherein said polymeric material of said blend is selected from the group of materials consisting of polyvinyl acetate, polyacrylate, and polyvinyl chloride.

14. The process according to claim 1 wherein said inorganic filler is selected from the group of fillers consisting of clay, calcium carbonate, mica, and talc.

15. The process according to claim 1 wherein said aqueous dispersion includes between about 12.5 and 60%, by weight, of said blend, based on the total weight of said dispersion.

* * * * *